United States Patent [19]

Federighi et al.

[11] Patent Number: 4,511,258

[45] Date of Patent: Apr. 16, 1985

[54] STATIC MATERIAL MIXING APPARATUS

[75] Inventors: James L. Federighi; Frank F. Federighi, both of Palatine, Ill.

[73] Assignee: Koflo Corporation, Arlington Heights, Ill.

[21] Appl. No.: 478,865

[22] Filed: Mar. 25, 1983

[51] Int. Cl.[3] ..... B01F 5/00; B01F 15/02

[52] U.S. Cl. ..... 366/337; 138/42; 366/338

[58] Field of Search ..... 366/336–340, 366/341, 349; 137/896; 138/38, 40, 42, 46; 48/180 R, 180 M, 180 B

[56] References Cited

U.S. PATENT DOCUMENTS

| | | | |
|---|---|---|---|
| 3,652,061 | 3/1972 | Chisholm | 366/337 |
| 4,019,719 | 4/1977 | Schuster et al. | 366/338 |
| 4,040,256 | 8/1977 | Bosche et al. | 366/337 X |

*Primary Examiner*—Timothy F. Simone

*Attorney, Agent, or Firm*—Robert E. Wagner; Ralph R. Rath

[57] ABSTRACT

A motionless mixing device includes a conduit having a mixing element therein which is formed by deforming flat stock material. The mixing element includes two substantially identical segments or halves that each having a sinuous cross-section between opposite ends and are interconnected along the center of the conduit with the two segments being axially staggered with respect to each other.

10 Claims, 4 Drawing Figures

STATIC MATERIAL MIXING APPARATUS

DESCRIPTION

1. Technical Field

The present invention relates generally to static mixtures and, more particularly, to a static material-mixing apparatus of the type having vanes within a conduit to mix two components into a homogeneous mass.

2. Background Prior Art

Static material-mixing apparatus' have been found very effective for mixing a plurality of materials into a single mass and one type of such mixer incorporating vanes for mixing two or more fluids is disclosed in patents, such as U.S. Pat. Nos. 3,635,444; 3,643,927; 3,664,638; and 3,800,985.

The mixing unit generally comprises fixing mixing vanes arranged in a row which extend endwise of the barrel. The vanes are arranged so that, as the material is discharged from one vane, it discharges with a swirling action about the axis of the barrel and strikes the next adjacent vane, which sub-divides the stream before it passes on to the next succeeding vane, which again sub-divides the sub-divisions. At each sub-division, each sub-division stream is realigned with a sub-divided stream different from the one from which it was sub-divided. Thus, as the materials pass through the length of the barrel, the stream is sub-divided and recombined in many different sub-combinations so many times that a completely homogeneous mixture is discharged from the discharge end of the mixer.

While this type of mixer has achieved a remarkable degree of commercial success, the cost thereof is substantial in that the initial cost for forming the vanes to various complicated geometric configurations is extremely high. Furthermore, with individual vanes of the type disclosed in the patents, the cost thereof is further increased by large assembly costs which requires proper positioning and affixing the various elements within an elongated conduit.

Because of the complicated construction of the vanes of baffles, large pressure drops are encountered in many commercial units.

In view of the foregoing, it would be highly advisable to have a static mixing device with lower pressure drops and one which could be produced economically.

SUMMARY OF THE INVENTION

According to the present invention, a unique method has been developed which can produce a mixing element at a minimum amount of cost in a minimum period of time. The mixing element is symmetrical with respect to its center so that there is no need for any accurate alignment with the conduit in which it is received.

The mixing element of the present invention consists of first and second substantially identical segments, each of which occupy approximately one-half of the internal configuration of a conduit that are interconnected along a center axis of the conduit. Each mixing segment includes a plurality of angularly-related plates connected to each other at opposite ends with each plate having a planar inner edge and an outer edge which conforms to the inner surface of the conduit. Each of the plates occupy approximately one-half of the internal area of the conduit, when viewed axially thereof, and the respective angularly-oriented plates are oriented in opposite directions from the axis so that the respective adjacent plates of the two segments define substantially equal angles on opposite sides of the center of the conduit.

The method of forming the mixing element consists of taking a generally flat rectangular plate and producing a plurality of slits along generally the center of the plate with the slits being interrupted by integral connecting portions connecting opposite sides of the sheet to each other. The respective sides are then bent in opposite directions with respect to each connecting portion to define angularly-related plates extending in opposite directions from the integral connection. The outer periphery or opposite edges of the plates are then machined or otherwise conformed to the internal configuraton of the conduit and are inserted therein and attached to the conduit.

BRIEF DESCRIPTION OF SEVERAL VIEWS OF DRAWINGS

DETAILED DESCRIPTION

Figure 1:
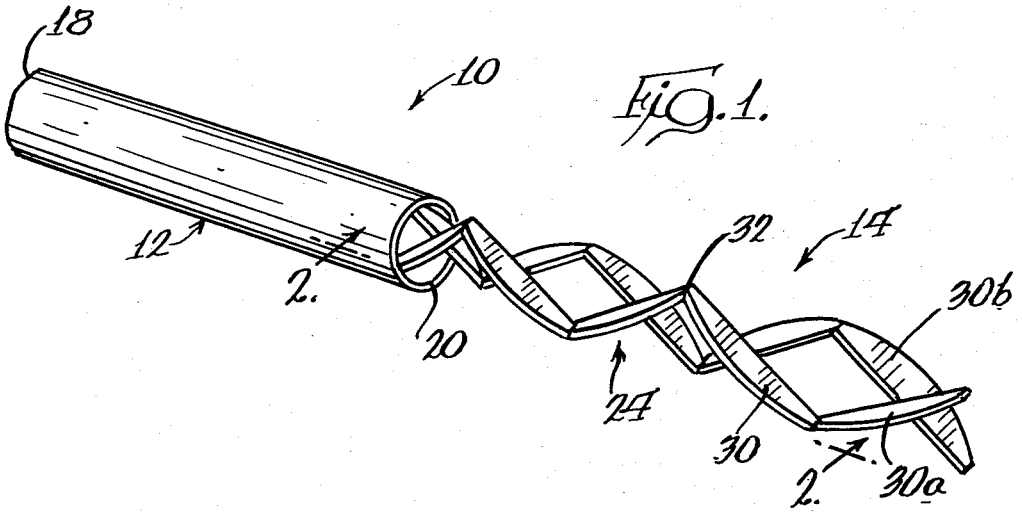
FIG. 1 is an exploded perspective view of the static material-mixing apparatus of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

FIG. 1 of the drawings discloses a static mixing device, generally designated by reference numeral 10, consisting of a conduit, generally designated by reference numeral 12, and a mixing element 14 that is adapted to be inserted into the conduit to define tortuous flow paths for a plurality of fluids so that the fluids are mixed into a homogeneous mass. Preferably, conduit 12 is circular in cross-section and defines an internal chamber 16 which is open at opposite ends 18 and 20. The opposite ends 18 and 20 may have suitable fittings thereon for connection to sources of materials that are to be mixed, and these have been deleted from the drawings for purposes of clarity.

According to the present invention, the mixing element 14 is of a specific configuration which can be formed from a flat sheet of stock material at minimum cost. After the element 14 has been formed, the element is inserted into the conduit 12 and may be secured therein. The novel mixing element essentially consists of first and second substantially identical segments that each have what may be termed as a "sinuous cross-section" between opposite ends.

Figure 2:
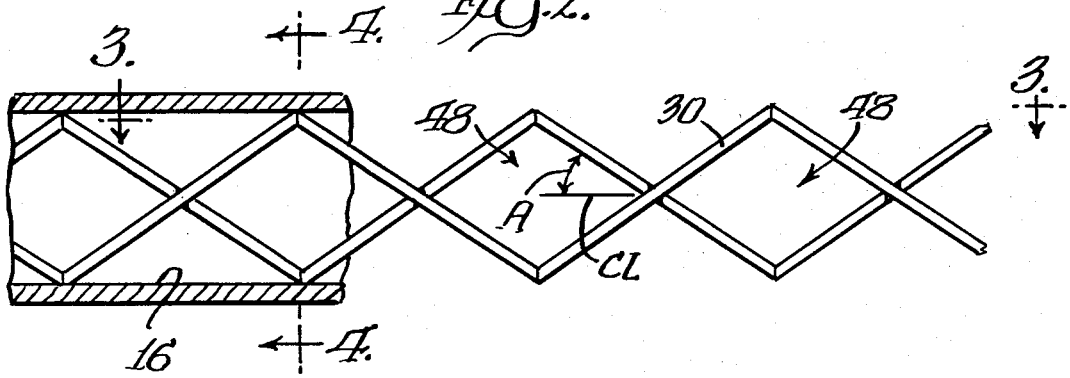
FIG. 2 is a side elevational view partly in section as viewed along line 2—2 of FIG. 1.
Figure 3:
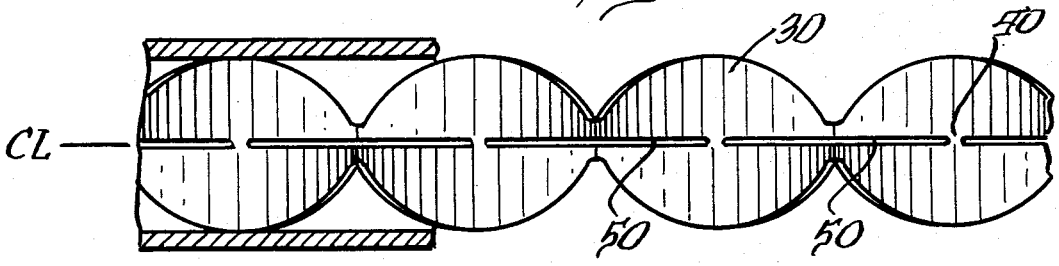
FIG. 3 is a plan view as viewed along line 3—3 of FIG. 2.
Figure 4:
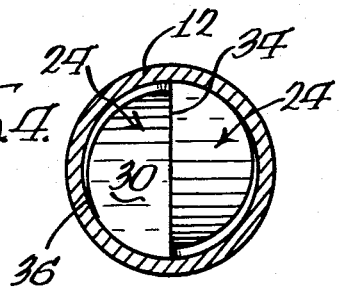
FIG. 4 is a cross-sectional view as viewed along line 4—4 of FIG. 2.

As illustrated in FIG. 4, each of the segments 24 occupies approximately one-half of the cross-sectional area of the conduit 12, or internal chamber 16. More specifically, each mixing segments consists of a plurality of identical, generally flat plates 30 that are joined to each other at opposite ends 32. Each plate or vane 32 has a substantially planar inner surface or edge 34 (FIG. 4) and an outer edge 36 that conforms generally to the peripheral configuration of chamber 16, which is defined by the inner surface of conduit 12. The two substantially identical segments are preferably axially-staggered with respect to each other, as illustrated in FIGS. 1 and 2, and the plates define an angle A with respect to the central axis or center line CL of the conduit. Also, as illustrated in FIG. 3, the respective plates are in engagement with each other generally along the center line or axis for conduit 12 and are preferably interconnected at these points of engagement. The interconnection is preferably an integral connection, as illustrated at 40 in FIG. 3 of the drawings.

As illustrated in FIG. 2, the vanes or plates 30 of the respective segments 24 define substantially equal angles with respect to center line CL, but the angles extend in opposite directions from the center line to define what may be termed a generally diamond-shaped cavity or mixing chamber, generally designated by reference numeral 48.

The method of forming the novel mixing element consists of selecting a sheet of flat stock material that has a width that is equal substantially to the width of the internal chamber 16 which, in the illustrated embodiment, would be equal to the internal diameter of the conduit 12. The flat sheet is then preformed with a plurality of slits 50 which are substantially equal to the axial length of the ultimate length of one vane with the slits being interconnected by connecting portions 40. Thus, the connecting or interrupted portions 40 define integral connections between adjacent plates 30. The respective plates 30 are then bent in opposite directions around the center connection 40 to produce equal angles for the respective adjacent plates which extend or open on opposite sides of the center axis of the conduit. The angle A is preferably selected to be on the order of about 25° to about 50°, or preferably about 30° to about 45°, for the preferred form of the present invention.

After the flat sheet of material, which can be formed from any number of metal or plastic materials, has been bent to the angular configuration illustrated in FIG. 1, the outer peripheral edges of the preformed sheet are machined or otherwise reduced to conform to the internal periphery of conduit 16. Of course, the conduit 16 could take other configurations other than the circular configuration illustrated in the drawings.

The simplicity of the device is apparent from the above description, which means that the mixing element can be manufactured at a very minimum cost and, since the unit is symmetrical about its center, there is no problem with radial alignment with the various elements, particularly when utilizing a circular conduit.

Once inserted into the conduit 12, the mixing element defines a tortious path for a plurality of materials that are intended to be mixed. For example, a first fluid could be connected by a conduit to one side of the center of the inlet 20 and a second fluid would be connected to the inlet 20 adjacent the opposite side of the center. Thus, the first fluid would flow generally downwardly along a first plate or baffle 30*a* (FIG. 1), while the second fluid would flow generally upwardly along baffle 30*b*. Both fluids are therefore forced towards the first mixing chamber 48 and enter the mixing chamber from opposite sides of the center of the conduit and the mixing process is commenced. As the two fluids are entering the mixing chamber, the fluids are spinning in different directions which will produce a swirling action. The partially-mixed fluids will be split again by the edges of vanes 30 as they leave the first mixing chamber and are directed to the next mixing chamber.

Of course, the respective fluids which are then partially mixed are again moved to the next succeeding chamber by the pressure of the fluid on the inlet, but enter again from opposite sides of the center of the conduit for further mixing of the fluids. The process is continued alternately in each chamber 48 along the entire length of the mixing element 14 within conduit 12 until a totally homogeneous mass is produced, which flows out of the outlet 18.

It has been determined that the mixing unit can be designed to have significantly less pressure drop between the inlet and outlet than most other competitive units.

The selection of material for producing the mixing unit will depend upon the application and the unit can be formed from metal or various plastic materials. It should also be noted that, while machining of the peripheral configuration of the mixing element has been disclosed, the peripheral configuration could be stamped or die cut while the sheet is in its flat state.

It should also be noted that a pair of plates such as plates 30*a* and 30*b* constitute what may be termed a single mixing element and any number of such elements may be incorporated into a mixing unit. The respective elements of a mixing unit will have alternating configurations which may be termed "left" and "right" when viewed in side elevation. Stated another way, the tips of each mixing element will be on the same plane with respect to its center, regardless of the orientation.

We claim:

1. A static material-mixing apparatus comprising a conduit having an axis and defining a chamber extending longitudinally therethrough opening on first and second ends of said conduit, a mixing element including two substantially identical continuous segments in said chamber between said first and second ends and each having a sinuous cross-section between said first and second ends, said segments being axially staggered and in engagement with each other generally along said axis with connection means between points of engagement so that said segments substantially close said chamber when viewed from one end thereof.

2. A static material-mixing apparatus as defined in claim 1 in which said segments each cover about one-half of said chamber.

3. A static material-mixing apparatus as defined in claim 2 in which said chamber and conduit are circular in cross-section.

4. A static material-mixing apparatus as defined in claim 1 in which each segment includes a plurality of angularly-related plates interconnected at opposite ends.

5. A static material-mixing apparatus as defined in claim 4 in which adjacent plates of the respective segments are angularly related in opposite directions and are interconnected along the center of said conduit.

6. A static material-mixing apparatus as defined in claim 5 in which said plates define angles of about 35° to about 45° with respect to said axis.

7. Mixing apparatus comprising a conduit defining a circular chamber open at opposite ends and having a center axis, a mixing element in said chamber between opposite ends, said mixing element comprising first and second mixing segments interconnected along said axis, each mixing segment comprising a plurality of angularly-related plates joined to each other at opposite ends, each plate having a planar inner edge and an outer edge conforming generally to an inner surface of said conduit, each of said plates occupying about one-half of said chamber when viewed axially thereof, adjacent plates of said first and second segments being angularly oriented in opposite directions from said axis.

8. Mixing apparatus as defined in claim 7, in which each plate is flat and defines an angle of about 35° to about 45° with said axis.

9. A one-piece mixing element for use in a conduit having axis and an inlet and an outlet on opposite ends, including a member having axially-spaced slits along a center thereof interrupted by integral connecting portions centrally of said member, said member being bent in opposite directions on opposite sides of each connecting portion to form generally flat baffles angularly oriented in opposite directions and defining approximately equal angles with respcet to the center thereof.

10. A one-piece mixing element as defined in claim 9 in which said generally flat baffles are interconnected at opposite ends and have generally arcuate peripheral edges to define a generally circular unit when viewed along said center.

* * * * *